US006702196B2

(12) United States Patent
Ohnishi et al.

(10) Patent No.: US 6,702,196 B2
(45) Date of Patent: Mar. 9, 2004

(54) CIRCUIT FOR DRIVING LIQUID DROP SPRAYING APPARATUS

(75) Inventors: Takao Ohnishi, Nishibiwajima (JP); Iwao Ohwada, Nagoya (JP); Toshikazu Hirota, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/290,034

(22) Filed: Nov. 7, 2002

(65) Prior Publication Data

US 2003/0116643 A1 Jun. 26, 2003

Related U.S. Application Data

(63) Continuation-in-part of application No. 09/701,552, filed on Jan. 8, 2001, now Pat. No. 6,508,411, and a continuation-in-part of application No. 09/640,163, filed as application No. PCT/JP00/02018 on Mar. 30, 2000, now abandoned.

(30) Foreign Application Priority Data

| | | |
|---|---|---|
| Mar. 31, 1999 | (JP) | 11-092906 |
| Aug. 20, 1999 | (JP) | 11-234445 |
| Aug. 23, 1999 | (JP) | PCT/JP99/04523 |
| Jul. 28, 2000 | (JP) | 2000-229485 |

(51) Int. Cl.[7] ..... B05B 3/04
(52) U.S. Cl. ..... 239/102.2; 239/102.1
(58) Field of Search ..... 239/102.1, 102.2, 239/450, 69, 1, 4, 5; 123/498, 548, 562

(56) References Cited

U.S. PATENT DOCUMENTS

| | | | | |
|---|---|---|---|---|
| 4,188,635 A | | 2/1980 | Giordano et al. | |
| 4,388,343 A | | 6/1983 | Voss et al. | |
| 4,418,354 A | | 11/1983 | Perduijn | |
| 5,152,457 A | * | 10/1992 | Burwell et al. | 239/102.2 |
| 5,248,087 A | | 9/1993 | Dressler | |
| 5,823,428 A | | 10/1998 | Humberstone et al. | |
| 5,900,690 A | | 5/1999 | Gipson et al. | |
| 5,938,117 A | | 8/1999 | Ivri | |
| 6,062,212 A | * | 5/2000 | Davison et al. | 128/200.16 |
| 6,116,517 A | * | 9/2000 | Heinzl et al. | 239/101 |
| 6,336,707 B1 | * | 1/2002 | Asai et al. | 347/46 |

FOREIGN PATENT DOCUMENTS

| | | | |
|---|---|---|---|
| EP | 1149602 A2 | * | 10/2003 |
| JP | 356113366 A | * | 9/1981 |
| JP | 04-039060 A | | 2/1992 |
| JP | 406198880 A | * | 7/1994 |
| JP | 08-300646 | | 11/1996 |
| JP | 10-107335 | | 4/1998 |

* cited by examiner

*Primary Examiner*—William E. Tapolcai
*Assistant Examiner*—Mohammad M. Ali
(74) *Attorney, Agent, or Firm*—Burr & Brown

(57) ABSTRACT

A circuit for driving a liquid drop spraying apparatus capable of smoothly supplying liquid to a pressurizing chamber is provided. A coil is provided in series with respect to a resistor that determines the charge characteristics of a charge circuit of a piezoelectric/electrostrictive element, thereby enabling gentle start characteristics when a charge voltage rises. In addition, discharge circuits are provided at two stages. A constant of the second discharging circuit is set to be smaller than a constant of the first discharging circuit. Coils are provided in series with resistors that determine their discharge characteristics. In this manner, even in the case where a large amount of liquid is sprayed, liquid is smoothly supplied to the pressurizing chamber.

10 Claims, 9 Drawing Sheets

FIG. 6

| Driving voltage | Switching voltage | Stability |
|---|---|---|
| 40V | 30V (75%) | △ |
| 40V | 25V (63%) | ○ |
| 40V | 20V (50%) | ○ |
| 40V | 15V (38%) | ○ |
| 40V | 10V (25%) | △ |

CIRCUIT FOR DRIVING LIQUID DROP SPRAYING APPARATUS

CROSS REFERENCE TO RELATED APPLICATIONS

This application is a continuation-in-part of U.S. application Ser. No. 09/640,163, filed Aug. 16, 2000 now abandoned, and U.S. application Ser. No. 09/701,552, filed Jan. 8, 2001, which was the National Stage of International Application No. PCT/JP00/02018, filed Mar. 30, 2000, the entireties of which are incorporated herein by reference.

BACKGROUND OF THE INVENTION

1. Field of the Invention

The present invention relates to a circuit for driving a liquid drop spraying apparatus used for a variety of machines, the liquid drop spraying apparatus treating a liquid or operating by spraying the liquid as a small amount of liquid drops.

2. Description of Prior Art

A liquid drop spraying apparatus is generally composed as shown in a longitudinal cross section of FIG. 7, including a piezoelectric or electrostrictive element 1 (piezoelectric/electrostrictive element) as a pressurizing means for spraying liquid. The piezoelectric/electrostrictive element 1 is provided on a wall face of a pressurizing chamber 2 for pressurizing liquid to be sprayed, a liquid drop spraying nozzle 3 is provided at the tip end of the pressurizing chamber, and an introducing hole 5 for supplying liquid to the pressurizing chamber 2 is formed at its proximal end, thereby entirely constituting a liquid drop spraying unit 6. This liquid drop spraying unit 6 is concurrently formed in plurality, and an introducing hole 5 for a plurality of the adjacent liquid drop spraying units 6, 6, . . . is coupled with a common liquid supply path 7.

A drive circuit for driving a liquid drop spraying apparatus deforms the wall of the pressurizing chamber 2 by applying a predetermined voltage signal to the piezoelectric/electrostrictive element 1 and charging the element. In this manner, the drive circuit generates a pressure at the pressurizing chamber 2, and causes the liquid supplied to the pressurizing chamber from the liquid drop spraying nozzle 3. In addition, the drive circuit causes power discharge and release deformation, thereby restoring the deformation of the pressurizing chamber 2, and causes liquid to flow from the introducing hole 5 to the pressurizing chamber.

In the meantime, in the liquid drop spraying apparatus, a large amount of liquid must be supplied for certain uses. In order to cope with such uses, the apertures of the nozzle and introducing hole have been increased in size.

If the aperture of the liquid drop spraying nozzle 3 is too large, however, only a small amount of liquid can be sprayed. The introducing hole 5 is not a mere path through which liquid is supplied to the pressurizing chamber 2, but serves to prevent back flow even if pressurization is performed so as to spray a small amount of liquid drops from the liquid spraying nozzle 3. Thus, the aperture cannot be widened infinitely.

Therefore, it is considered that if the time interval for applying a predetermined voltage signal to the piezoelectric/electrostrictive element 1 is shortened, the number of signal applications per unit time is increased, and the number of supplies to the liquid drop spraying apparatus is increased. In that case, if the time interval for applying the voltage is shortened, there occurs a new problem, in that a delay in liquid supply from the introducing hole 5 to the pressurizing chamber 2 occurs, and a large amount of liquid cannot be constantly supplied.

In addition, the piezoelectric/electrostrictive element acts as a capacitor. Charging/discharging is repeated when the spraying operation is repeated. Thus, when an operating period is shortened, power consumption is further increased, and the calorific value is increased.

A technique to cope with the above increased power consumption is described in Japanese Patent Application Laid-open No. 10-107335 or Japanese Patent No. 2909150. A technique for shortening the application period of a voltage signal per unit time is disclosed in Japanese Patent Application Laid-open No. 8-300646. In Japanese Patent Application Laid-open No. 10-107335, there is disclosed an arrangement in which an external capacitor is provided for power recollection, a coil that is an inductance is interposed in a charge/discharge circuit, and part of a discharge of the piezoelectric/electrostrictive element is effectively stored in the external capacitor and utilized for the next charge, thereby ensuring power saving. In Japanese Patent No. 2909150, there is disclosed an arrangement in which piezoelectric elements to be driven at different timings are mutually utilized as power recollecting means, thereby reducing power consumption without additionally providing an external circuit.

However, in all of these arrangements, although there is provided an advantageous effect on saving power consumption, a technique for constantly spraying a large amount of liquid is not described. Thus, the delay in liquid supply from the introducing hole to the pressurizing chamber is not solved.

In addition, in Japanese Patent Application Laid-open No. 8-300646, there is disclosed an arrangement in which the rise of a drive voltage wavelength is divided into two stages and/or three stages, whereby the stability of meniscus is improved and the occurrence of satellite drops is suppressed. As a result of reducing a constant during discharge when the waveform is divided into three stages, the printing speed is increased, thereby making it possible to increase an ink discharge quantity. However, discharge start characteristics are not smooth at the respective stages. Thus, the printing speed cannot be significantly increased, and the discharge quantity cannot be significantly increased.

In view of the foregoing problems, even in the case where a large amount of liquid is sprayed, it is an object of the present invention to provide a circuit for driving a liquid drop spraying apparatus capable of smoothly supplying liquid to the pressurizing chamber.

SUMMARY OF THE INVENTION

In order to solve the foregoing problems, according to a first aspect of the present invention, the following is provided. A liquid drop spraying apparatus comprises a plurality of units for spraying a small amount of liquid drops, wherein each unit comprises a liquid drop spraying nozzle, a pressurizing chamber for pressurizing liquid to be sprayed from the nozzle, an introducing hole for supplying liquid to the pressurizing chamber, and a piezoelectric/electrostrictive element for operating the pressurizing chamber to be pressurized. The liquid introducing holes of the plurality of the adjacent liquid drop spraying units are coupled with a common liquid supply path, and there is provided a liquid drop spraying apparatus driving circuit for applying a predetermined voltage signal to the piezoelectric/electrostrictive element, thereby deforming the wall of the pressurizing chamber, and discharging from the nozzle the liquid to be supplied to the pressurizing chamber by a pressure produced in the pressurizing chamber. The ratio between the introducing hole diameter and the nozzle hole diameter (introducing hole diameter/nozzle hole diameter) is in a range of 0.6 to 1.6, and the ratio between the nozzle hole diameter and nozzle thickness (nozzle hole diameter/nozzle thickness) is in a range of 0.2 to 4. An applied voltage signal supplies a current to the piezoelectric/electrostrictive element to charge the element, and then holds the final charge voltage for a predetermined time after applying the current. Discharging with two or more time constants during discharge is then performed sequentially. The time constant during the first discharging is greater than the time constant during the second discharging, and the second discharging is started at a voltage that is 35% to 70% of a voltage difference between the charging start voltage and the final charge voltage when the charging start voltage is defined as a reference. An inductance and a resistor are interposed in at least one discharge circuit in series with respect to the piezoelectric/electrostrictive element.

With this arrangement, when liquid drops are sprayed during the charging of the piezoelectric/electrostrictive element, when a charge is discharged, the time constant during discharging of the first discharge circuit is large, and thus, the piezoelectric/electrostrictive element can start deformation gently. In the case where liquid drops are sprayed simultaneously from a plurality of liquid drop spraying units, an operation for introducing liquid into a plurality of pressure chambers is reliably performed. Then, this operation goes to a suction operation in which the time required for discharging a unit voltage value is short. Thus, liquid is supplied to the pressurizing chamber smoothly and within a short time, and the amount of liquid supply can be increased.

If the second discharging begins at a voltage less than 35%, gentle suctioning (at the first discharge time constant) dominates too much of the entire suctioning step. Suctioning itself is reliably performed, but a large amount of suctioning per unit time cannot be provided. As a result, the spraying period cannot be shortened, and a large amount of spray cannot be ensured. In addition, if the time constant of the first discharging is comparatively small in a range which is greater than the time constant during the second discharging so as to provide the suction quantity per unit time, unstable suctioning starts, resulting in a spray fault. In addition, if the second discharging begins at a voltage more than 70%, discharging at the larger, first discharge time constant (i.e., gentle suctioning) is too small to smoothly start liquid suctioning. Then, the suction quantity of liquid from the liquid introducing hole to the liquid pressurizing chamber after discharge is decreased, and the entrapment of air bubbles from the liquid discharge nozzle occurs, resulting in unstable spraying.

Further, when spraying is performed as described above, a large ratio between the nozzle and the introducing hole (introducing hole diameter/nozzle hole diameter) is preferable in consideration of suctioning. However, the rate at which the pressure during spraying escapes to the introducing hole side is large, and the spraying force is shortened. Alternatively, if the above rate is small, it causes shortage of the quantity of liquid supply against the spray quantity. Thus, the ratio between the introducing hole diameter and the nozzle hole diameter (introducing hole diameter/nozzle hole diameter) is preferably 0.6 to 1.6.

Furthermore, the ratio between the nozzle hole diameter and nozzle thickness (nozzle hole diameter/nozzle thickness) is preferably 0.2 or more and 4 or less. When the ratio is 4 or less, the residual vibration of the liquid level immediately after spraying can be converged speedily by a contact resistance between the liquid on the nozzle wall face. Still furthermore, air bubbles can be prevented from entry into the pressurizing chamber with the pressure change in the pressurizing chamber during discharge, and the spray stability can be improved. As a result, spraying can be done in a short period of time, and the spray quantity can be increased. In addition, when the ratio is 0.2 or more, there can be prevented a spray fault generated due to the shortage of the spraying force with a large contact resistance of the liquid on the nozzle wall face.

Yet furthermore, when the ratio between the introducing hole and the nozzle hole, the ratio between the nozzle hole and the nozzle thickness, and the discharge voltage rate are met simultaneously, the spray fault due to air bubble entry is prevented, whereby a large amount of spray can be ensured.

According to a second aspect of the present invention, as in the first aspect, there is provided a circuit for driving a liquid drop spraying apparatus, wherein a time (t4), measured from the time when discharging is started at the second discharge time constant to the time when the next predetermined voltage signal is applied to the piezoelectric/electrostrictive element, is ¼ or more and 20 times or less than that of a specific vibration period (To) when liquid is supplied to a flow path composed of the liquid spraying nozzle, the pressurizing chamber for pressurizing the liquid discharged from the nozzle, the introducing hole for supplying liquid to the pressurizing chamber, and the piezoelectric/electrostrictive element for operating the pressurizing chamber to be pressurized. The ratio (t3/t4) between a time (t3) when discharging begins using the first discharge time constant and the time (t4) is in a range of 0.1 to 20.

With this arrangement, when the time (t4), from the time when the piezoelectric/electrostrictive element starts discharging at the second discharge time constant to the time when the next predetermined voltage signal is applied, is less than ¼ of the specific vibration period (To), the suction speed of liquid from the liquid introducing hole to the liquid pressurizing chamber after spraying is too fast. Even if suctioning is started at the first charging without any fault, the liquid supply from the introducing hole is too late when suctioning is effected during the second discharging. Thus, air bubbles enter the pressurizing chamber from the liquid drop spraying nozzle, resulting in a spray fault. In addition, when the rate is more than 20 times To, a large amount of suction per unit time cannot be provided. As a result, the spray period cannot be shortened, and a large amount of spray cannot be ensured.

Further, when the ratio between a time (t3), when discharging is effected at the first discharge time constant, to a time (t4), when a predetermined voltage signal is applied to the next piezoelectric/electrostrictive element, is less than 0.1, the rate of the first discharging with its large time constant is small. Thus, the ratio of the liquid suction quantity during the first discharging to the entire suction quantity decreases, and suctioning is too late during the second discharge suctioning. Then, air bubbles enter the pressurizing chamber from the liquid drop spraying nozzle, causing a spray fault. In addition, when the above ratio is more than 20, a large amount of suction quantity per unit time cannot be provided. As a result, the spray period cannot be shortened, and a large amount of spray cannot be ensured.

According to a third aspect of the present invention, as in the first and second aspects thereof, in addition to a discharge circuit, an inductance and a resistor are interposed in series with respect to the charge circuit.

With this arrangement, the voltage/time gradient during spraying is made linear, and the stability of liquid spraying is improved.

According to a fourth aspect of the present invention, in a liquid drop spraying apparatus comprising a liquid drop spraying nozzle; a pressure chamber for pressurizing liquid discharged from the nozzle, and a piezoelectric/electrostrictive element for operating the pressure chamber to be pressurized, wherein the liquid introducing holes of a plurality of the adjacent liquid drop spraying units are coupled with a common liquid supply path, there is provided a discharge circuit for a liquid drop spraying apparatus for repeatedly discharging a piezoelectric/electrostrictive element to which a predetermined voltage signal has been applied, thereby changing the wall of the pressurizing chamber and discharging from the nozzle the liquid supplied to the pressurizing chamber with a pressure generated in the pressurizing chamber. The ratio between the introducing hole diameter and the nozzle hole diameter (introducing hole diameter/nozzle hole diameter) is in a range of 0.6 to 1.6, and the ratio between the nozzle hole diameter and nozzle thickness (introducing hole diameter/nozzle thickness) is in a range of 0.2 to 4. The discharge circuit discharges a current from the piezoelectric/electrostrictive element to which a charge voltage has been applied, and then holds the final discharge voltage for a predetermined time. Charging with two or more different charge time constants is then performed sequentially, and the second charging is started at a voltage that is 30% to 65% of a voltage difference between the final discharge voltage and the discharge start voltage when the final discharge voltage is defined as a reference. The first charge time constant is greater than the second charge time constant. An inductance and a resistor are interposed in series with respect to the piezoelectric/electrostrictive element in at least one charge circuit.

With this arrangement, in the case where liquid drops are sprayed during discharge of the piezoelectric/electrostrictive element, a time constant is large when first charging the charge circuit. Thus, the piezoelectric/electrostrictive element can start shape restoration gently. In the case where liquid drops are sprayed from a plurality of liquid drop spraying units simultaneously, the operation for introducing liquid to a plurality of pressure chambers is reliably performed. Then, this operation goes to a suction operation in which the time required to charge a unit voltage value is short. Thus, the liquid supply to the pressure chambers can be performed smoothly and within a short time, and the liquid supply quantity can be increased.

If the second charging begins at a voltage more than 65%, gentle suctioning (at the first charge time constant) dominates too much of the entire suctioning step. Although suctioning is reliably performed, a large amount of suctioning per unit time cannot be provided. As a result, the spraying period cannot be shortened. Therefore, a large amount of spray cannot be ensured. If the first charge time constant is comparatively smaller within the range that is greater than the second charge time constant so as to provide the suction quantity per unit time, unstable suctioning is started, resulting in a spray fault. In addition, if the second charging begins at a voltage less than 30%, the rate of charging at the first charge time constant (i.e., gentle suctioning) is too small to perform liquid suctioning start speedily, and unstable spraying occurs.

Further, when spraying is performed as described above, a large ratio between the introducing hole diameter and the nozzle hole diameter (introducing hole diameter/nozzle hole diameter) is preferable in view of suctioning. However, the rate at which the spraying pressure escapes to the introducing hole side is large, and the spraying force becomes short. Alternatively, if the ratio is small, it causes a shortage of the quantity of liquid supply to the spray quantity. Thus, the ratio between the introducing hole diameter and the nozzle hole diameter (introducing hole diameter/nozzle hole diameter) is preferably 0.6 to 1.6.

Further, when the ratio between the introducing hole diameter and the nozzle hole diameter, the ratio between the nozzle hole diameter and nozzle thickness, and the charge voltage ratio are met simultaneously, spray faults due to air bubble entry are prevented, and a large amount of spray can be ensured.

According to a fifth aspect of the present invention, as in the fourth aspect thereof, a time (t40), from the time when charging is started at the second charge time constant to a time when the next predetermined voltage signal is applied to the piezoelectric/electrostrictive element, is ¼ or more and 20 times or less of a specific vibration period (To) when liquid is supplied to a flow path composed of the liquid spraying nozzle, the pressurizing chamber for pressurizing liquid discharged from the nozzle, the introducing hole for supplying liquid to the pressurizing chamber, and the piezoelectric/electrostrictive element for operating the pressurizing chamber to be pressurized. The ratio (t30/t40) between a time (t30), when charging is performed at the first charge time constant, and the time (t40), is 0.1 or more and 20 or less.

With this arrangement, when t40 is less than ¼ of (To), the suctioning speed is too high. Thus, even if suctioning is started at the first charging without any failure, liquid supply from the introducing hole is too late when suctioning is performed at the second charging. Then, air bubbles enter the pressurizing chamber from the nozzle hole, and spraying cannot be performed. In addition, when t40 is more than 20 times (To), a large amount of suction per unit time cannot be provided. As a result, the spraying time cannot be shortened, and a large amount of spray cannot be ensured.

According to a sixth aspect of the present invention, as in the fourth and fifth aspects thereof, in addition to a charge circuit, an inductance and a resistor are interposed in series with respect to the discharge circuit.

By doing this, the voltage/time gradient during spraying becomes linear, and the stability of liquid drop spraying is improved.

According to a seventh aspect of the present invention, in a liquid drop spraying apparatus comprising a liquid drop spraying nozzle, a pressurizing chamber for pressurizing liquid sprayed from the nozzle, an introducing hole for supplying liquid to the pressurizing chamber, and a piezoelectric/electrostrictive element for operating the pressurizing chamber to be pressurized, wherein the liquid introducing holes of a plurality of the adjacent liquid drop spraying units are coupled with a common liquid supply path, there is provided a circuit for driving a liquid drop spraying apparatus for applying a predetermined voltage signal to the piezoelectric/electrostrictive element, thereby deforming the wall of the pressurizing chamber, and discharging from the nozzle the liquid supplied to the pressurizing chamber, wherein the applied voltage signal supplies a current to the piezoelectric/electrostrictive element, and then holds a final charge voltage for a predetermined time. Discharging with two or more different discharge time constants is then performed sequentially, and the first discharge time constant is greater than the second discharge time constant. An inductance and a resistor are interposed in series with respect to the piezoelectric/electrostrictive element in at least one discharge circuit, the piezoelectric/electrostrictive elements are divided into at least two groups, a circuit for charging and discharging a current is provided at their respective groups, and at least part of the discharge current of one group is used for part of the charge current of the other group.

With this arrangement, when liquid drops are sprayed during piezoelectric/electrostrictive element charging, when a charge is discharged, the discharge time constant of the first discharge circuit is large. Thus, the piezoelectric/electrostrictive element can start deformation gently. In the case where liquid drops are sprayed from a plurality of liquid drop spraying units simultaneously, an operation for introducing liquid to a plurality of pressure chambers can be reliably performed. Then, this operation goes to a suction operation in which a time required to discharge a unit voltage value is short. Thus, liquid can be supplied to the pressure chamber smoothly and within a short time, and the liquid supply quantity can be increased.

In addition, the discharge power of one piezoelectric/electrostrictive element is directly employed as a charge current for the other piezoelectric/electrostrictive element. Thus, there is no need to newly provide discharging means, and further, power consumption can be saved.

According to an eighth aspect of the present invention, in a liquid drop spraying apparatus comprising a liquid drop spraying nozzle, a pressurizing chamber for pressurizing liquid sprayed from the nozzle, an introducing hole for supplying liquid to the pressurizing chamber, and a piezoelectric/electrostrictive element for operating the pressurizing chamber to be pressurized, wherein the liquid introducing holes of a plurality of the adjacent liquid drop spraying units are coupled with a common liquid supply path, there is provided a discharge circuit for a liquid drop spraying apparatus for discharging the piezoelectric/electrostrictive element, thereby deforming the wall of the pressurizing chamber, and spraying from the nozzle the liquid supplied to the pressurizing chamber with a pressure generated at the pressurizing chamber, wherein the discharge circuit discharges a current from the piezoelectric/electrostrictive element to which a charge voltage has been applied, and then holds a final discharge voltage for a predetermined time. Charging with two or more different charge constants is then performed sequentially, and the first charge time constant is greater than the second charge time constant. An inductance and a resistor are interposed in series with respect to the piezoelectric/electrostrictive element in at least one charge circuit, the piezoelectric/electrostrictive elements are divided into at least two groups, a circuit for charging and discharging a current is provided at their respective groups, and at least part of the discharge current of one group is used for part of the charge current of the other group.

With this arrangement, when liquid drops are sprayed during piezoelectric/electrostrictive element discharging, when charging, the charge time constant of the first charge circuit is large. Thus, the piezoelectric/electrostrictive element can start shape restoration gently. In the case where liquid drops are sprayed from a plurality of liquid drop spraying units simultaneously, an operation for introducing liquid to a plurality of pressure chambers can be reliably performed. Then, this operation goes to a suction operation in which a time required to charge a unit voltage value is short. Thus, liquid can be supplied to the pressure chamber smoothly and within a short time, and the liquid supply quantity can be increased.

In addition, the discharge power of one piezoelectric/electrostrictive element is directly employed as a charge current for the other piezoelectric/electrostrictive element. Thus, there is no need to newly provide discharging means, and further, power consumption can be saved.

According to a ninth aspect of the present invention, as in the seventh aspect thereof, in addition to a discharge circuit, an inductance and a resistor are interposed in series with respect to a charge circuit.

By doing this, the voltage/time gradient during spraying is made linear, and the stability of liquid drops spray is improved.

According to a tenth aspect of the present invention, as in the eighth aspect thereof, in addition to a charge circuit, an inductance and a resistor are interposed in series with respect to a discharge circuit.

By doing this, the voltage/time gradient during spraying is made linear, and the stability of liquid drops spray is improved.

BRIEF DESCRIPTION OF THE DRAWINGS

For a better understanding of the present invention, reference is made to the following detailed description of the invention, taken in conjunction with the following drawings in which:

FIG. 2(*b*) shows control signals for FIG. 2(*a*); and FIG. 2(*c*) shows voltage waveforms when the piezoelectric/electrostrictive element causes drop spraying upon discharging;

FIG. 6 is a view investigating the stability of the liquid drop spraying apparatus when the discharge time constant of the voltage waveform shown in FIG. 2(*a*) is changed;

DETAILED DESCRIPTION OF THE INVENTION

Figure 1:
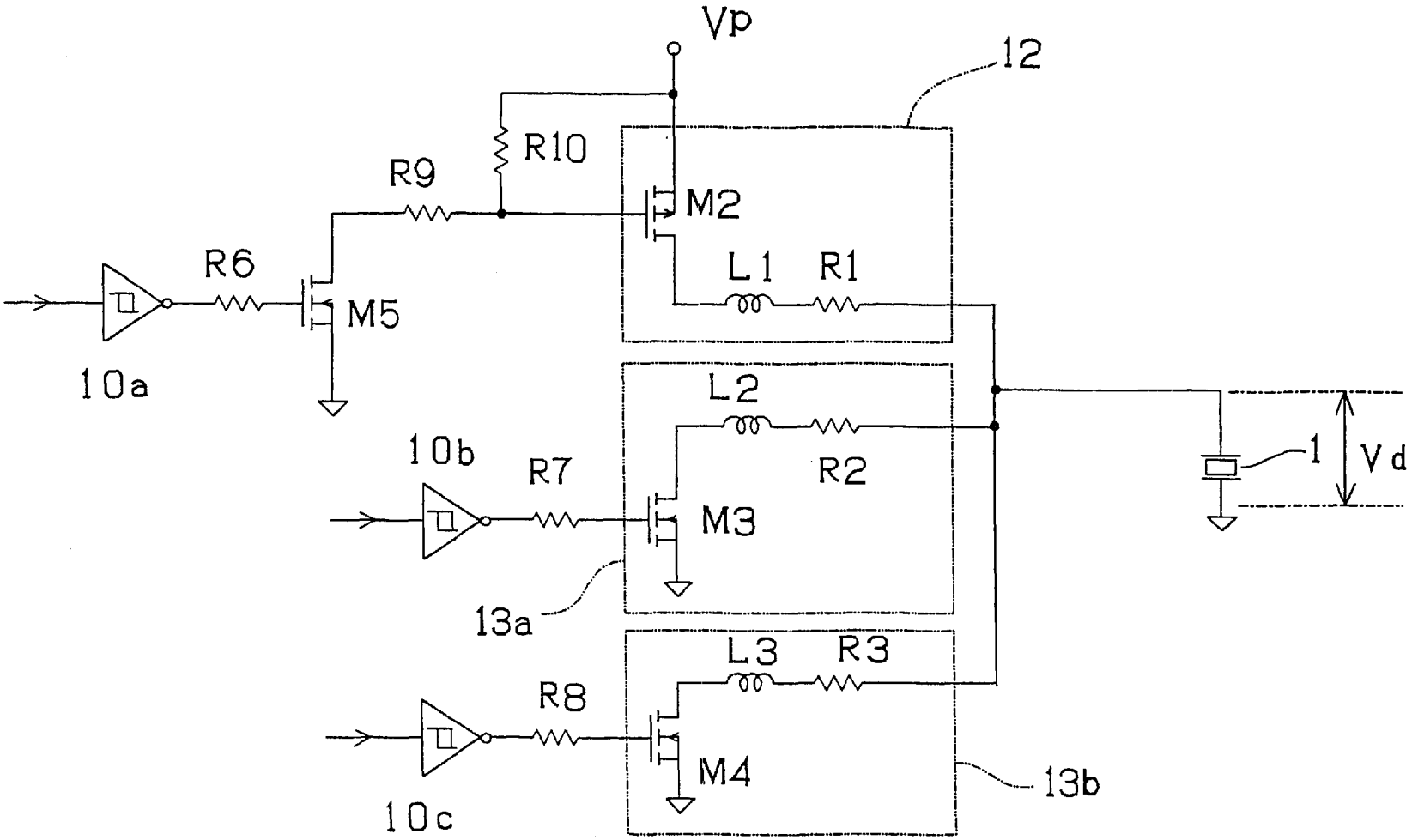
FIG. 1 is a circuit diagram illustrating an example of a circuit for driving a liquid drop spraying apparatus according to the present invention.

Hereinafter, preferred embodiments of the present invention will be described in detail with reference to the accompanying drawings. FIG. 1 shows an example of a circuit for driving a liquid drop spraying apparatus according to the present invention, the circuit causing spraying operation during piezoelectric/electrostrictive element charging. Reference numbers (10*a* to 10*c*) denote a Schmidt trigger IC for converting a signal from a control unit (not shown) such as a microcomputer to a drive circuit operating signal. Reference numerals R6, R7, and R8 each denote resistors for limiting a charge of Schmidt trigger IC 10, reference numeral M2 denotes a charge switch consisting of a P-MOSFET that supplies a charge current to a piezoelectric/electrostrictive element 1 (hereinafter, referred to as a pressurizing element), and reference numerals M3 and M4 denote first and second discharge switches each consisting of N-MOSFETs for discharging the pressurizing element 1.

The charge switch M2 forms a charge circuit 12 together with a coil L1 and a resistor R1 provided in series at its output, and is controlled by a Schmidt trigger IC 10*a* via a switch M5. In addition, a first discharge circuit 13*a* is formed by the first discharge switch M3 and the coil L2 and resistor R2 provided in series at its discharge circuit, and is controlled by a Schmidt trigger IC 10*b*. In addition, a second discharge circuit 13*b* is formed by the second discharge switch M4 and the coil L3 and resistor R3 provided in series at its discharge circuit, and is controlled by a Schmidt trigger IC 10*c*. Here, in the second discharge circuit 13*b*, a time T4 required to discharge a unit voltage value when discharging is started (this is determined by the coil L3, resistor R3, and capacitor C1) is set to be shorter than a time T3 required to discharge a unit voltage value when discharging is started in the first discharge circuit. 'Vp' denotes a power supply voltage, and 'Vd' denotes a voltage applied to the pressurizing element.

Figure 2:
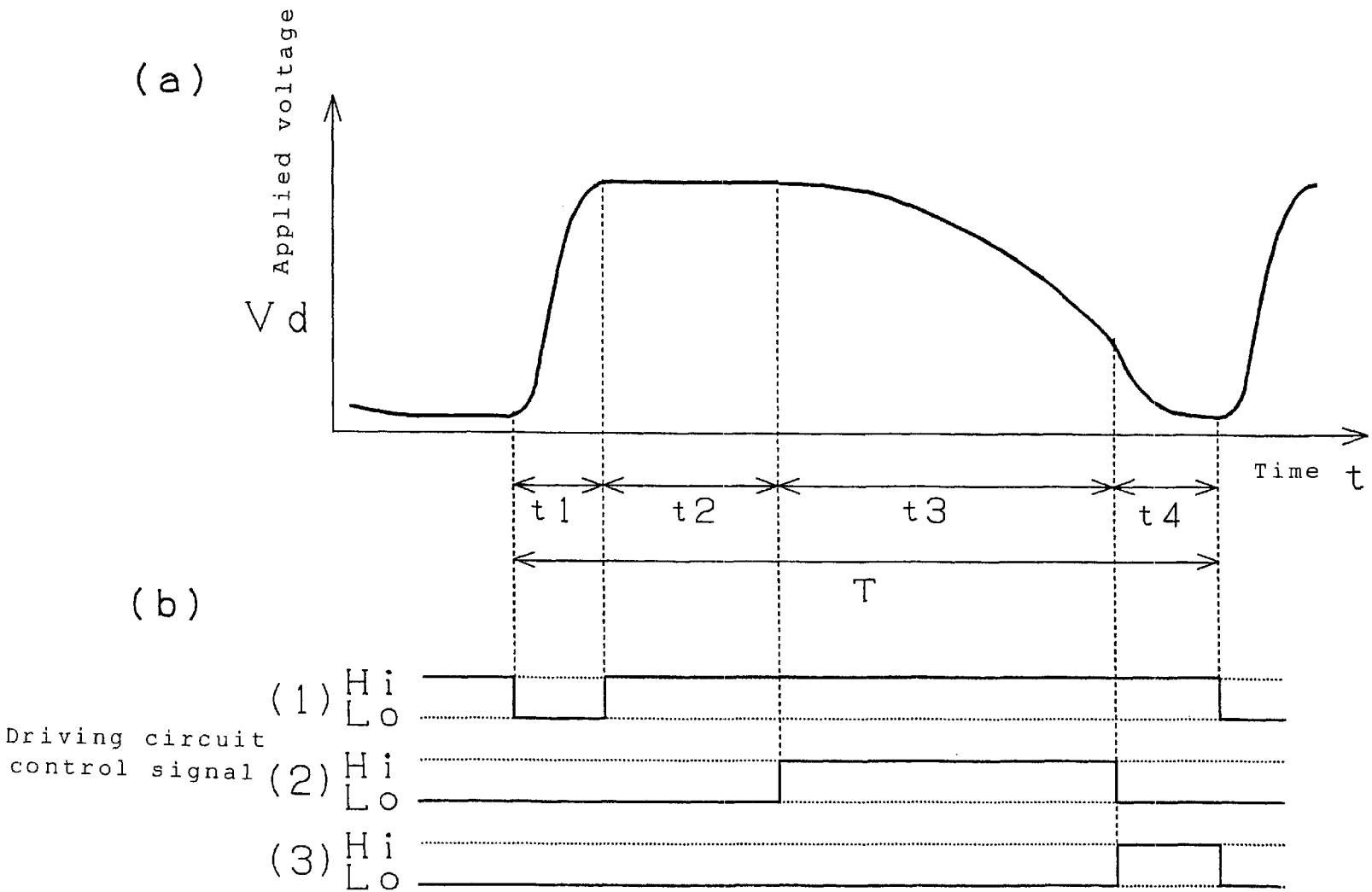
FIG. 2(*a*) and FIG. 2(*b*) each show operating characteristics of the driving circuit shown in FIG. 1, wherein FIG. 2(*a*) shows voltage waveforms applied to the piezoelectric/electrostrictive element to cause drop spraying upon charging.
Figure 2C:
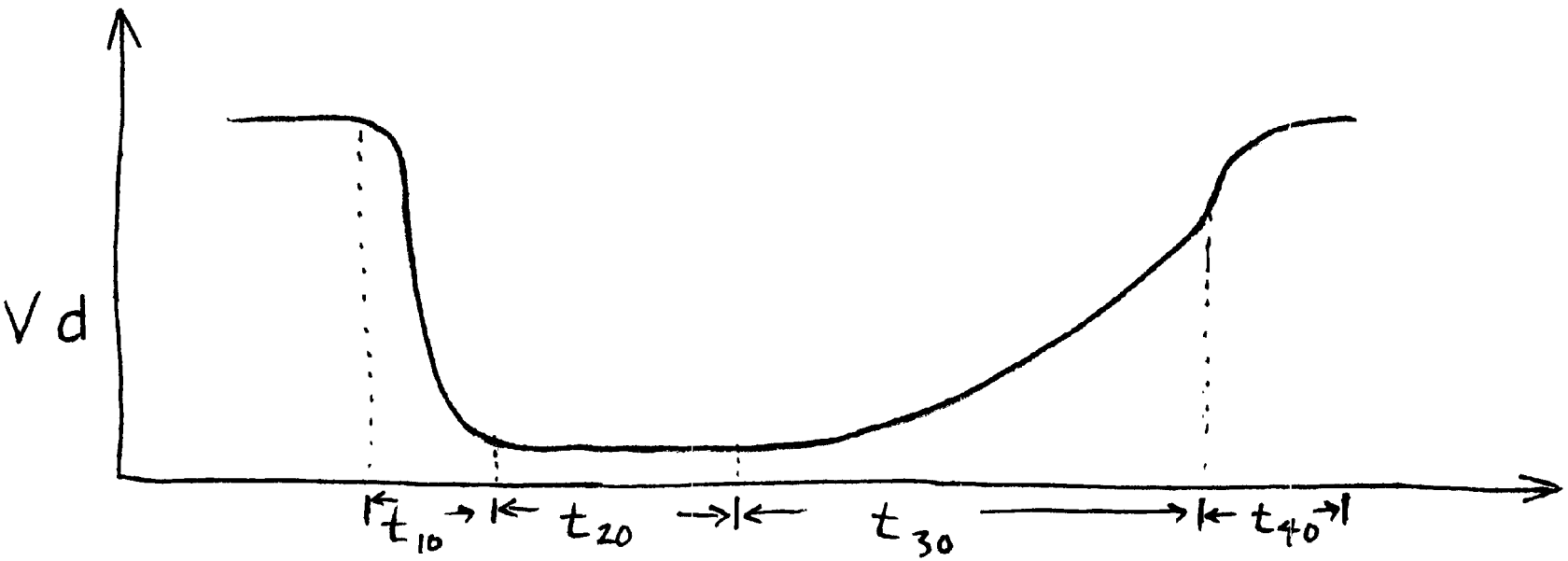

FIG. 2(*a*) shows the characteristics of a voltage applied to the pressurizing element of the driving circuit shown in FIG. 1, wherein 't1' denotes a rise time for the charge circuit to charge the pressurizing element 1, the pressurizing element is gently risen by action of the coil L1, and the rise time 't1' is adjusted by the coil L1 and resistor R1 as a time to ensure that the applied voltage 'Vd' reaches a desired voltage value. The pressurizing element 1 is deformed by this charging operation, the pressurizing chamber 2 is pressurized, and liquid drops are sprayed from the liquid drop spraying nozzle 3. In addition, 't2' denotes a hold time for maintaining for a predetermined time a state in which the liquid has been sprayed in order to stabilize the pressure chamber 2 and the liquid contained in the pressurizing chamber.

Times 't3' and 't4' are fall times for sequentially operating the first discharge circuit 13*a* and the second discharge circuit 13*b*. Time 't4' required to discharge a unit voltage value when discharging of the second discharge circuit 13*b* is started is smaller than time 't3' required to discharge a unit voltage when discharging of the first discharge circuit 13*a* is started. Thus, the discharge characteristics at time 't4' are protruded to be smaller than the discharge characteristics at time 't3'. However, in any of these characteristics, a change when discharging is started becomes gentle by action of the coils L2 and L3. In addition, the coil L2 is provided, thereby a circuit without the coil L3 can be preferably used in consideration of a balance between the spray quantity and the supply quantity.

In this manner, discharge circuits are provided at two stages, a change in the applied voltage 'Vd' during fall is first gentle and rapid in the middle, whereby the liquid is supplied from the introducing hole 5 to the pressurizing chamber 2 because the pressurizing element 1 is deformed back toward its original position. Since the supply speed is first low, suctioning can be started uniformly from a plurality of introducing holes 5. The liquid suction speed at which the change is rapid in the middle, and the flow to the pressurizing chamber is started is accelerated, and a large amount of liquid can be suctioned. In comparing a case in which the liquid is suctioned to the end at the first suction speed, the drive period time T can be shortened, and the spray quantity from the nozzle can be increased in proportion to such shortening. Therefore, the liquid drop spray per a unit time can be increased.

In addition, the coil L1 is interposed in the charge circuit 12, wherein the applied voltage 'Vd' does not rise rapidly when charging is started. Thus, the residual vibration followed by spraying with deformation of the pressurizing element 1 can be eliminated, the gradient of voltage/time can be stabilized, the spraying of liquid drops can be stabilized, air bubbles are not introduced from the nozzle during suctioning operation, and an occurrence of a spray failure can be prevented. Therefore, the hold time 't2' can be shortened, the liquid spray quantity can be further increased, and the liquid can be supplied smoothly to the pressurizing chamber.

In addition, a change in applied voltage is made gentle by the coils L2 and L3 when discharging is started. Thus, the liquid can be further suctioned efficiently and the liquid supply quantity is further increased, and the spray quantity can be increased.

FIG. 2(*b*) shows a control signal of a drive circuit. In the figure, (1) denotes an output signal of Schmidt trigger IC 10*a*, (2) denotes an output signal of Schmidt trigger IC 10*b*, and (3) denotes an output signal of Schmidt trigger IC 10*c*. As shown, in the charge circuit 12, a 'Lo' signal is output from the Schmidt trigger IC 10*a*, whereby the charge switch M2 is turned ON, causing liquid drop spraying operation. In two discharge circuits 13*a* and 13*b*, a 'Hi' signal is output sequentially from a respective one of the Schmidt trigger ICs 10*b* and 10*c*, whereby the switches M3 and M4 are turned ON, causing liquid suction operation.

Although the discharge time constant for liquid supply is switched at two stages, the time constant may be set so as to be reduced at two or more stages and more gradually. In addition, in order to change charge and discharge characteristics, resistors R1 to R3 may be changed, and a desired waveform can be set inexpensively.

Further, the pressurizing element 1 is charged in order to spray liquid drops, and deformation occurs in the pressurizing chamber 2. In contrast, in the case where deformation is caused to occur in the pressurizing chamber 2 by discharging from the pressurizing element 1, thereby spraying liquid drops, charge circuits with their different charge characteristics are provided at two stages, and the discharge circuit may be formed as one stage, as shown in FIG. 2(*c*).

Figure 5:
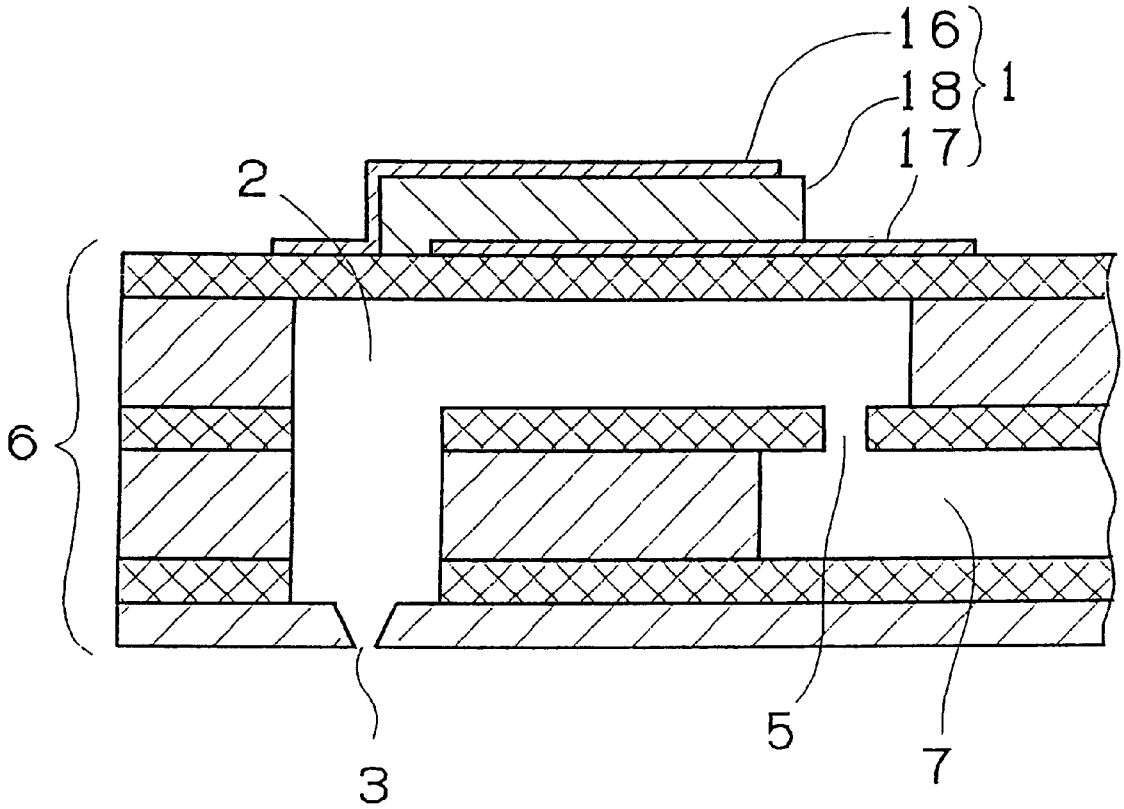
FIG. 5 is an illustrative view illustrating a longitudinal cross section of the center of a liquid drop spraying unit driven by the circuit for driving the liquid drop spraying apparatus shown in FIG. 1.
Figure 7:
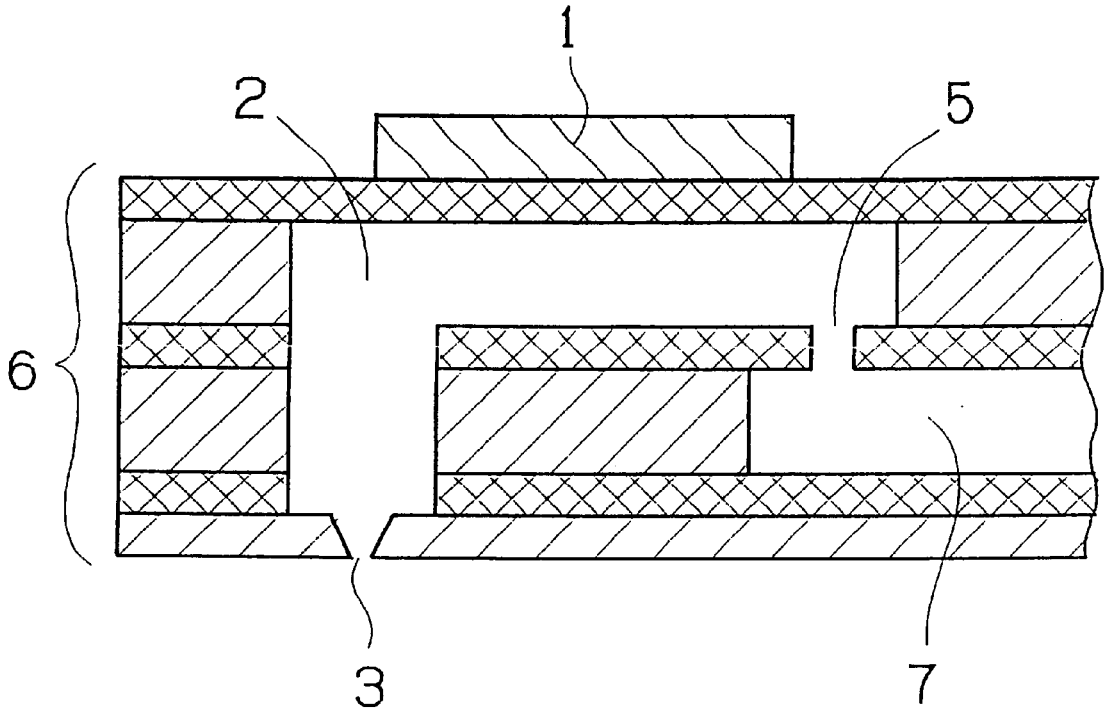
FIG. 7 is an illustrative view illustrating a central cross section of a liquid drop spraying unit of the liquid drop spraying apparatus.

FIG. 5 shows an example of a liquid drop spraying apparatus that operates using the above driving circuit, and is a longitudinal cross section illustrating the center of a liquid drop discharging unit. This liquid drop spraying apparatus comprises a plurality of units according to the use mode by defining as one unit a liquid drop discharge unit 6 each comprising pressurizing means for discharging liquid, a pressurizing chamber 2 for pressurizing liquid to be discharged, a liquid discharge nozzle 3 coupled downwardly with the pressurizing chamber 2, the nozzle discharging liquid to a treatment unit of the liquid drop spraying apparatus, and an introducing hole 5 for supplying liquid to the pressurizing chamber 2.

In the liquid drop discharge unit 6, a plurality of the adjacent pressurizing chambers 2, 2 . . . are coupled with each other by means of a common liquid supply path 7 via the introducing hole 5, and a piezoelectric/electrostrictive element 1 is provided as pressurizing means at a part of the upward wall of the pressurizing chamber 2. The piezoelectric/electrostrictive element 1 laminates an upper electrode 16, a piezoelectric/electrostrictive layer 18, and a lower electrode 17. By applying a predetermined voltage signal, the piezoelectric/electrostrictive layer 18 is deformed by electrophoresis generated between the upper and lower electrodes 16 and 17. Then, the liquid supplied to the pressurizing chamber 2 is discharged from the nozzle 3 by the pressurizing force generated at the pressurizing chamber 2 by deforming the wall of the fixed pressurizing chamber 2.

The ratio between the diameter of the introducing hole 5 and the nozzle 3 diameter (introducing hole diameter/nozzle hole diameter) is between 0.6 and 1.6, for example, 1.0, and the ratio between the nozzle hole diameter and nozzle thickness (nozzle hole diameter/nozzle thickness) is between 0.2 and 4, for example, 2.

The ratio between the diameter of the introducing hole 5 and the nozzle 3 diameter is between 0.6 and 1.6, whereby a balance in spraying force and suction force is obtained, and the shortage of the spray force or suction force is not eliminated. If the introducing hole diameter/nozzle hole diameter ratio exceeds 1.6, it provides good suctioning. However, the rate at which the pressure during spraying escapes to the introducing hole side is increased, and a shortage of the spraying force occurs. In addition, if the ratio is smaller than 0.6, it causes a shortage of the quantity of liquid supplied to the spray quantity.

Further, if the nozzle hole diameter/nozzle thickness ratio is 4 or less, the residual vibration of the liquid level immediately after spraying can be converged speedily by a liquid contact resistance on the nozzle wall face. Further, air bubbles are prevented from entering the pressurizing chamber 2 due to the vibration in internal pressure of the pressurizing chamber during discharge, and the spray stability can be improved. As a result, the liquid can be sprayed within a short period, and the spray quantity can be increased. If the above ratio is 0.2 or more, the shortage of the spraying force due to an increased liquid contact resistance on the nozzle wall face occurs, and a spray fault can be prevented. In the above embodiment, the nozzle hole diameter is in a range of 25 microns to 100 microns.

In addition, FIG. 6 is measurement data indicative of the stability of the spraying operation of the liquid drop spraying apparatus by changing a voltage from discharge due to the first discharge time constant to discharge due to the second discharge time constant when the drive voltage of the piezoelectric/electrostrictive element is constant at 40 V, and is constant when t1=20 microseconds, t2=5 microseconds, t3=20 microseconds, and t4=10 microseconds.

As shown, when a voltage migrating to discharge due to the second discharge time constant is between 38% and 63% of the final discharge voltage, spraying operation can be preferably performed, and preferable operation is not indicated at 25% and 75%. In this way, the voltage for starting second discharge is ranged, second discharging is preferably started at a voltage from 35% to 70% of the applied voltage, that is, of the charge voltage. If the ratio between the introducing hole diameter and the nozzle hole diameter, the ratio between the nozzle hole diameter and nozzle thickness, and the second discharge start voltage are met simultaneously, a spray fault due to entrapment of air bubbles from the liquid drop spraying nozzle is prevented, and a large amount of spray can be ensured.

When the second discharge start voltage is less than 35%, discharging at the first discharge time constant (i.e., gentle suctioning) dominates too much of the entire suctioning step. Suctioning itself is reliably performed, but a large suction quantity per unit time cannot be provided. As a result, the spray period cannot be shortened, and a large amount of spray cannot be ensured. In addition, if a comparative suction time is set to be small in a range in which the first discharge time constant is greater than the second discharge time constant, so as to provide a suction quantity per unit time, unstable suctioning is started, and the shortage of spray quantity is caused. In addition, if the above rate is more than 70%, discharging at the first discharge time constant is too small to speedily start liquid suctioning. Consequently, the liquid suction quantity from the liquid introducing hole 5 to the liquid pressurizing chamber after discharge decreases, and the entrapment of air bubbles in the nozzle 3 occurs, resulting in unstable spraying.

Further, a time 't4' at which discharging is performed at the second discharge time constant is ¼ or more and 20 or less of the specific vibration period 'To', as defined above. The ratio 't3/t4', between the first discharge time 't3' and the second discharge time 't4', is preferably 0.1 to 20. By setting this range, the liquid from the introducing hole can be supplied smoothly relevant to the suction speed, and spraying operation can be well performed without air bubble entry from the nozzle to the pressurizing chamber.

When the time 't4' is less than To/4, the suction speed is too high. Thus, even if the first discharge is well performed, liquid supply from the introducing hole is too late because of suctioning operation during the second discharge, air bubbles enter the pressurizing chamber 2 from the nozzle 3, and a spray fault occurs. In addition, when the time 't4' is more than 20T, a large amount of suction quantity per unit time cannot be provided. As a result, the spray period cannot be shortened, and a large amount of discharge cannot be ensured. Further, in the case where the ratio of t3/t4 is less than 0.1, the rate of the first discharge with its large time constant is small, and the ratio of liquid suction rate during the first discharge to the entire suction quantity decreases. Thus, suctioning is too late when suctioning is performed during second discharge, and a spray fault is likely to occur. When the above ratio is more than 20, an advantageous effect due to the setting of the second discharge time constant is eliminated. In view of a large amount of spray, an advantageous effect due to increasing the drive frequency can be utilized as more effective means.

The discharge time constant for liquid supply is switched into two stages. It is preferable to set the discharge time constant so as to be increased at two or more stages and gradually. In addition, a piezoelectric/electrostrictive element is charged for the purpose of liquid drop spraying, and a pressurizing chamber is deformed. In contrast, in the case where discharging is performed from the piezoelectric/electrostrictive element, thereby causing deformation in the pressurizing chamber, and spraying liquid drops, charging with the second charge time constant is started at a voltage that is 30% to 65% of the discharge start voltage.

Figure 8:
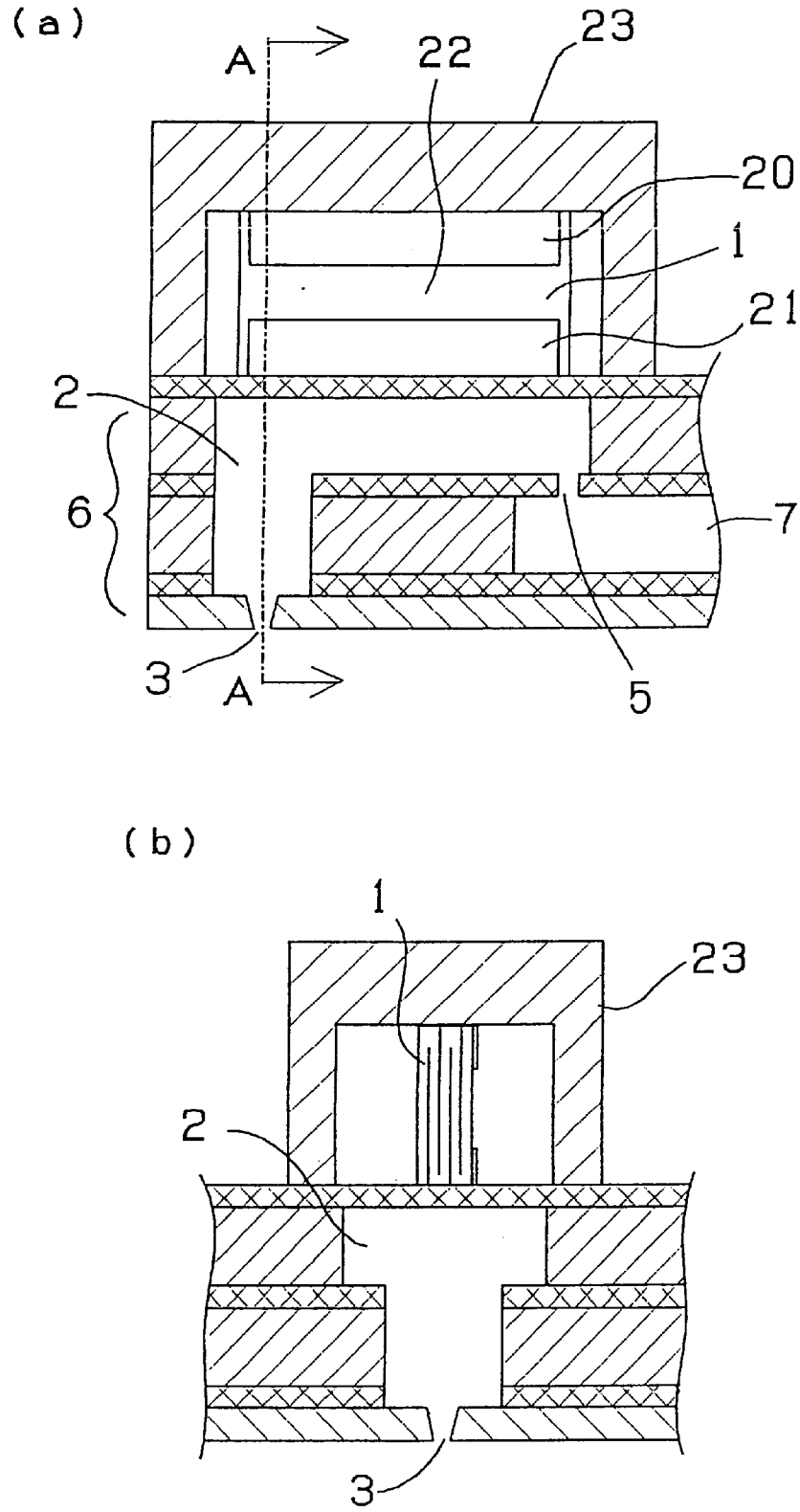
FIGS. 8(*a*) and 8(*b*) illustrate another example of the liquid drop spraying unit driven by the circuit for driving the liquid drop spraying apparatus shown in FIG. 1.

FIGS. 8(*a*) and 8(*b*) are illustrative views of a liquid drop spraying unit that causes reverse operation (see FIG. 2(*c*)) with respect to the liquid drop spraying apparatus shown in FIG. 5 and that deforms the pressurizing chamber during discharge to spray liquid drops by employing an MLP (laminated actuator) for the piezoelectric/electrostrictive element, wherein FIG. 8(*a*) is a longitudinal cross section, and FIG. 8(*b*) is an arrow view of the cross section taken along line A—A. In the figures, reference numeral 23 denotes a fixing member for fixing the piezoelectric/electrostrictive element, reference numeral 20 denotes a positive electrode, reference numeral 21 denotes a negative electrode, and reference numeral 22 denotes a piezoelectric/electrostrictive layer. Like constituent elements, identical to those shown in FIG. 5, are denoted by like reference numbers.

In the case of the illustrative embodiment, the ratio between the introducing hole diameter and the nozzle hole diameter and the ratio between the nozzle hole diameter and nozzle thickness may be similar to that shown in the above-described illustrative embodiment, the second charge start voltage may be 30 to 65% of a voltage difference between the final voltage and the charge start voltage when the final voltage is defined as a reference. In addition, the time 't40', at which charging is performed at the second charge time constant, may be ¼ or more and 20 times or less of the specific vibration period To, as is the case with the above-described illustrative embodiment, and the ratio 't30/t40', between the charge time 't30' with the first charge time constant and the charge time t40 may be 0.1 to 20.

Figure 3:
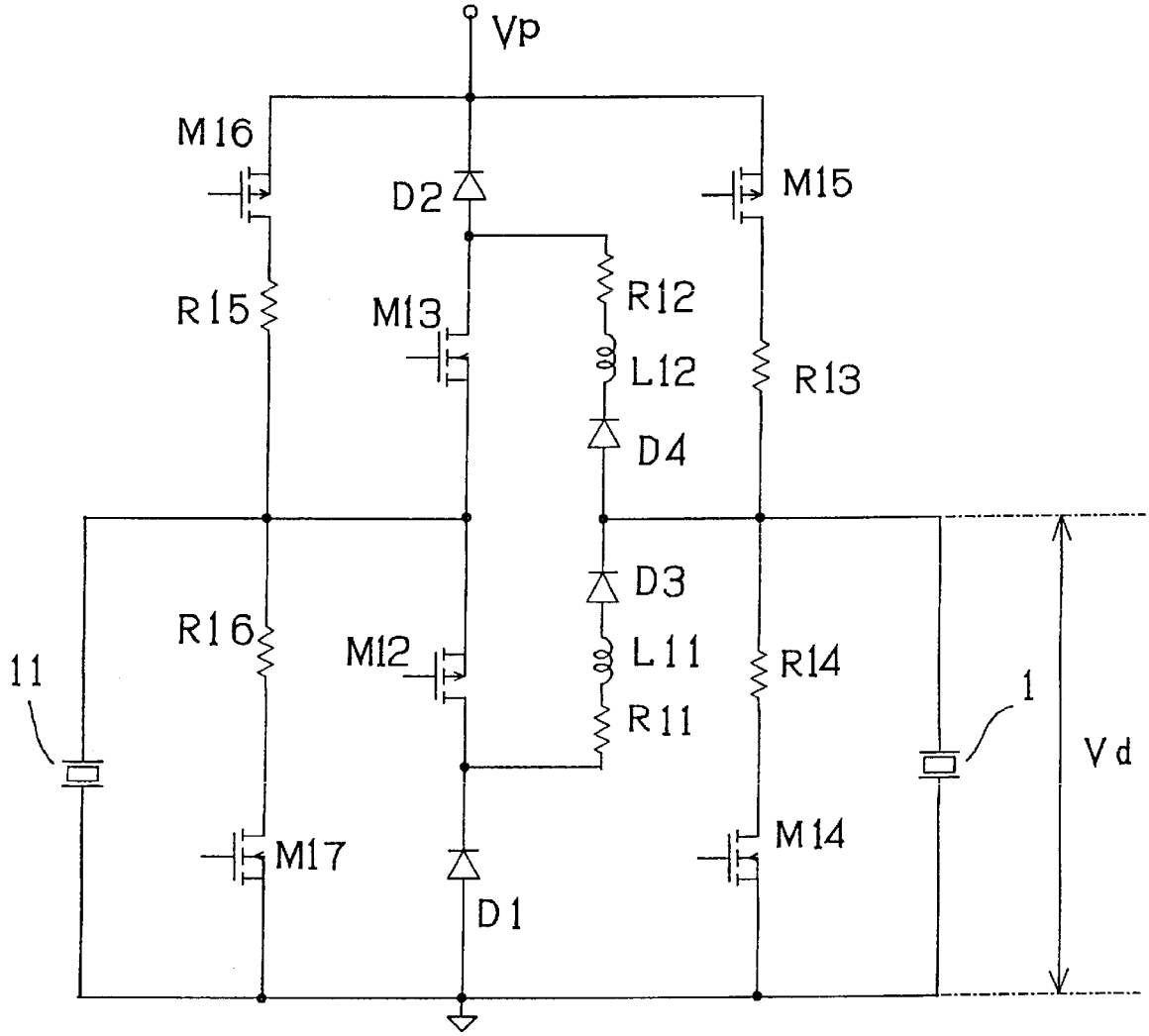
FIG. 3 is a circuit diagram of a circuit for driving a liquid drop spraying apparatus showing a second embodiment of the present invention.

FIG. 3 is a circuit diagram of essential portions illustrating a second embodiment of the present invention, wherein a second pressurizing element 11 is provided as power storage means for power saving. A charge circuit consists of three FETs with a first charge switch M12, a second charge switch M15, and a third charge switch M16. A discharge circuit is formed of three FETs with a first discharge switch M13, a second discharge switch M14, and a third discharge switch M17. In addition, resistors R11 to R16 each determine charge and discharge characteristics of each circuit together with both of the pressurizing elements 1 and 11. In first charge switch M12 and the first discharge switch M13, coils L11 and L12 are inserted in series into resistors R11 and R12. D1 to D4 each denote a diode.

Figure 4:
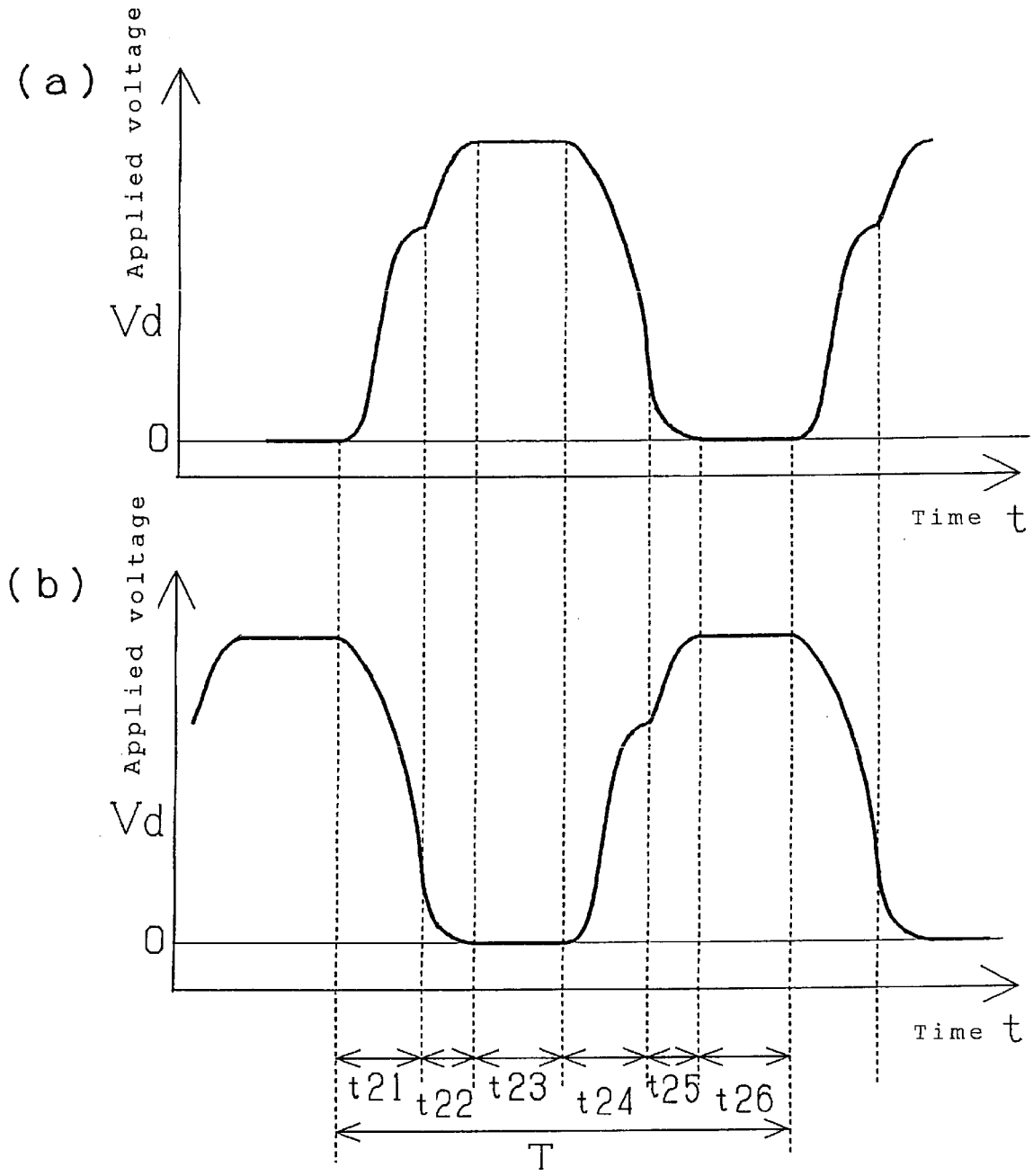
FIGS. 4(*a*) and 4(*b*) are views showing applied voltage waveforms.

The operation of this circuit will be described with reference to the applied voltage characteristic charts shown in FIGS. 4(*a*) and 4(*b*). FIG. 4(*a*) shows an applied voltage waveform of a first pressurizing element 1, and FIG. 4(*b*) shows an applied voltage waveform of a second pressurizing element 11. At a first charge period 't21', a first charge switch M12 is first turned ON, thereby discharging a second pressurizing element 11, and the first pressurizing element 1 is charged by the discharge from element 11. At a second charge time 't22', a second charge switch M15 is then turned ON, thereby charging the shortage of charge, and a third discharge switch M17 is turned ON, thereby completely discharging the pressurizing element 11.

Then, at a period 't23', after its state has been held for a predetermined time, the first discharge switch M13 is turned ON at the first discharge time 't24', thereby discharging power from element 1, and its discharge is used to charge second pressurizing element 11. At a second discharge time 't25', the second discharge switch M14 is turned ON, thereby discharging the residual capacity from element 1, and the third charge switch M16 is turned ON, thereby charging the shortage of the charge of the second pressurizing element 11, and its state is held at a time 't26'. In this time, when the time 't21' is started, 't21' to 't26' are defined as one period for charging and/or discharging, the first and second pressurizing elements 1 and 11 operate in synchronism with each other, and the voltage waveform is repeatedly applied.

In this manner, when pressurizing elements operated by shifting a half period are provided, these mutual elements can be employed as power storage means, and a discharge charge can be efficiently utilized without additionally providing power storage means such as a capacitor. Therefore, in the case where a plurality of pressurizing elements are provided, these pressurizing elements are divided into two or more groups. When the elements are operated by shifting about a half period, at least part of the discharge current of one group can be used for at least part of the charge current of the other group, and power consumption can be further saved.

Although the above illustrative embodiment is composed of an analog circuit, the drive waveform is generated by means of a digital signal. This digital signal can be converted into an analog signal, and the drive waveform can be preferably set. In addition, although a charge switch or a discharge switch is fully MOS shaped FET, the driving circuit may be composed of a transistor without being limited thereto.

Advantageous Effect of the Invention

As has been described above in detail, according to the present invention, liquid can be supplied to a plurality of pressurizing chambers smoothly and within a short time, and the liquid supply quantity can be increased. In addition, liquid suctioning can be started gently, the liquid can be suctioned efficiently, and the liquid supply quantity can be further increased. Therefore, the application period can be further shortened, the liquid ejection quantity can be further increased, and the liquid can be supplied to the pressurizing chambers smoothly.

We claim:

1. A circuit for driving a liquid drop spraying apparatus including a plurality of units for spraying a small amount of liquid drops, each unit comprising a liquid spraying nozzle, a pressure chamber for pressurizing liquid to be sprayed from the nozzle, an introduction hole for supplying liquid to the pressure chamber, and a piezoelectric/electrostrictive element for operating the pressure chamber, wherein the introduction hole of each unit communicates with a common liquid supply path, the ratio of a diameter of the introduction hole to a diameter of the nozzle is in a range of 0.6 to 1.6, and the ratio of a diameter of the nozzle to the thickness of the nozzle is in a range of 0.2 to 4, said circuit comprising:

at least one charging circuit for providing an applied voltage signal to the piezoelectric/electrostrictive element to deform a wall of the pressure chamber and eject from the nozzle the liquid supplied to the pressure chamber by a pressure produced in the pressure chamber, and for holding a final charge voltage for a predetermined time; and at least one discharging circuit comprising at least one inductor and at least one resistor connected in series with said piezoelectric/electrostrictive element, said discharging circuit sequentially performing first and second discharging steps with at least two discharge time constants, wherein the first discharge time constant is greater than the second discharge time constant, said discharging circuit starting the second discharging step at a voltage that is 35% to 70% of a voltage difference between a starting charge voltage and a final charge voltage when the starting charge voltage is defined as a reference.

2. A circuit for driving a liquid drop spraying apparatus according to claim 1, wherein a time (t4), from a time when discharging is started with the second discharge time constant to a time when a next predetermined voltage signal is applied to the piezoelectric/electrostrictive element, is in a range of ¼ to 20 times that of a specific vibration period (To) when liquid is supplied to the flow path, wherein a ratio (t3/t4) between a time (t3) when discharging is effected with the first discharge time constant and the time (t4) is in a range of 0.1 to 20.

3. A circuit for driving a liquid drop spraying apparatus according to claim 1, wherein said charging circuit includes at least one inductor and at least one resistor connected in series with said piezoelectric/electrostrictive element.

4. A circuit for driving a liquid drop spraying apparatus according to claim 1, comprising at least first and second units including first and second piezoelectric/electrostrictive elements, respectively, wherein current discharging from said first piezoelectric/electrostrictive element is used to charge said second piezoelectric/electrostrictive element.

5. A circuit for driving a liquid drop spraying apparatus including a plurality of units for spraying a small amount of liquid drops, each unit comprising a liquid spraying nozzle, a pressure chamber for pressurizing liquid to be sprayed from the nozzle, an introduction hole for supplying liquid to the pressure chamber, and a piezoelectric/electrostrictive element for operating the pressure chamber, wherein the introduction hole of each unit communicates with a common liquid supply path, the ratio of a diameter of the introduction hole to a diameter of the nozzle is in a range of 0.6 to 1.6, and the ratio of a diameter of the nozzle to the thickness of the nozzle is in a range of 0.2 to 4, said circuit comprising:

at least one discharging circuit for discharging current from the piezoelectric/electrostrictive element from a starting discharge voltage to a final discharge voltage thereby deforming a wall of the pressure chamber and discharging from the nozzle the liquid supplied to the pressure chamber by a pressure produced in the pressure chamber, said discharging circuit holding a final discharge voltage for a predetermined time; and at least one charging circuit comprising at least one inductor and at least one resistor connected in series with said piezoelectric/electrostrictive element, said charging circuit sequentially performing first and second charging steps with at least two charge time constants, wherein the first charge time constant is greater than the second charge time constant, said charging circuit starting the second charging step at a voltage that is 30% to 65% of a voltage difference between a final discharge voltage and a starting discharge voltage when the final discharge voltage is defined as a reference.

6. A circuit for driving a liquid drop spraying apparatus according to claim 5, wherein a time (t40), from a time when charging is started with the second charge constant to a time when the next predetermined voltage signal is applied to the piezoelectric/electrostrictive element, is in a range of ¼ to 20 times that of a specific vibration period (To) when liquid is supplied to a flow path, wherein a ratio (t30/t40) of a time (t30) when charging is performed with the first charge time constant to the time (t40) is in a range of 0.1 to 20.

7. A circuit for driving a liquid drop spraying apparatus according to claim 5, wherein said discharging circuit includes at least one inductor and at least one resistor arranged in series with said piezoelectric/electrostrictive element.

8. A circuit for driving a liquid drop spraying apparatus according to claim 5, comprising at least first and second units including first and second piezoelectric/electrostrictive elements, respectively, wherein current discharging from said first piezoelectric/electrostrictive element is used to charge said second piezoelectric/electrostrictive element.

9. A circuit for driving a liquid drop spraying apparatus according to claim 4, wherein said charging circuit includes at least one inductor and at least one resistor connected in series with said piezoelectric/electrostrictive element.

10. A circuit for driving a liquid drop spraying apparatus according to claim 8, wherein said discharging circuit includes at least one inductor and at least one resistor arranged in series with said piezoelectric/electrostrictive element.

* * * * *